US007242897B2

(12) United States Patent
Satoh et al.

(10) Patent No.: US 7,242,897 B2
(45) Date of Patent: Jul. 10, 2007

(54) IMAGE FORMING APPARATUS, ROLLER, BELT, AND FIXING UNIT OF IMAGE FORMING APPARATUS

(75) Inventors: Masahiko Satoh, Funabashi (JP); Akira Shinshi, Tokyo (JP); Naoki Iwaya, Kawasaki (JP)

(73) Assignee: Ricoh Co., Ltd., Tokyo (JP)

( * ) Notice: Subject to any disclaimer, the term of this patent is extended or adjusted under 35 U.S.C. 154(b) by 155 days.

(21) Appl. No.: 11/116,354

(22) Filed: Apr. 28, 2005

(65) Prior Publication Data

US 2006/0116230 A1 Jun. 1, 2006

(30) Foreign Application Priority Data

Apr. 28, 2004 (JP) ..... 2004-133192

(51) Int. Cl.
*G03G 15/00* (2006.01)
*G03G 15/16* (2006.01)
*G03G 15/20* (2006.01)

(52) U.S. Cl. ..... 399/329; 198/821; 198/840; 399/162; 399/303; 399/308; 399/313

(58) Field of Classification Search ..... 399/329, 399/162, 303, 313, 302, 308; 198/840, 835, 198/821, 846, 844.1
See application file for complete search history.

(56) References Cited

U.S. PATENT DOCUMENTS 5,017,969 A * 5/1991 Mitomi et al. ..... 198/835 X
5,369,477 A * 11/1994 Foote et al. ..... 198/840 X
5,778,294 A * 7/1998 Hiraoka et al. ..... 399/329
6,871,038 B2 * 3/2005 Fujiwara ..... 399/303
2002/0001492 A1 * 1/2002 Takeuchi ..... 399/303
2002/0044807 A1 * 4/2002 Uehara et al. ..... 399/329 X
2002/0046932 A1 * 4/2002 Wakana ..... 198/840
2003/0206749 A1 * 11/2003 Kashiwabara et al. .. 399/302 X
2006/0165429 A1 11/2005 Satoh et al.
2007/0059003 A1 9/2006 Shinshi et al.
2007/0059071 A1 9/2006 Shinshi et al.

FOREIGN PATENT DOCUMENTS

JP 63-188000 A * 8/1988
JP 2001-142350 5/2001
JP 2002-145429 A * 5/2002
JP 2002-148983 5/2002

* cited by examiner

*Primary Examiner*—Sophia S. Chen
(74) *Attorney, Agent, or Firm*—Oblon, Spivak, McClelland, Maier & Neustadt, P.C.

(57) ABSTRACT

A tubular roller to support a belt having an inner surface provided with a protruding circumferential edge having a width includes a first portion, a second portion, and a third portion. The first portion has a first outer radius and contacts the inner surface of the belt. The second portion has a second outer radius smaller than the first outer radius of the first portion. The third portion is connected to the first portion with a first vertically extending wall and to the second portion with a second vertically extending wall and has a third outer radius smaller than the second outer radius.

22 Claims, 3 Drawing Sheets

IMAGE FORMING APPARATUS, ROLLER, BELT, AND FIXING UNIT OF IMAGE FORMING APPARATUS

TECHNICAL FIELD

This application claims priority from Japanese patent application No. 2004-133192 filed on Apr. 28, 2004 in the Japan Patent Office, the entire contents of which are incorporated herein by reference.

The following disclosure relates generally to an image forming apparatus, and a roller for extending a belt provided in the image forming apparatus.

BACKGROUND

Image forming apparatuses have been marketed as electro-photocopying apparatuses, printers, facsimile devices, or the like, or as multifunctional apparatuses having at least one combination of these devices. Such image forming apparatus includes a fixing belt, an image carrying belt (e.g., intermediate transfer belt), and a transport belt for transporting a recording medium or a document.

Conventionally, belts in the above-mentioned image forming apparatus are provided with a belt straightener to prevent the belt to wave. Such a straightener protrudes from an inner circumferential portion of the belt and engages with a groove-type engagement portion provided to a belt roller around which the belt extends. With such arrangement, the belt straightener may not disengage from the groove-type engagement portion, thereby preventing the belt from waving.

Conventionally, belt rollers include solid-type rollers. However, fixing belt rollers are tubular in order to accommodate a heater inside and have a relatively small heat capacity so as to insure a short heat-response time. Furthermore, the use of tubular rollers for image carrying belts and transport belts is also desired so as to reduce the weight of the image forming apparatus. Furthermore, belt rollers disposed near a fixing unit are more susceptible to heat energy generated in the fixing unit. If a solid-type roller is used in such area, heat dissipation from the roller is more difficult. Accordingly, tubular rollers are preferred in order to reduce heat effects in such areas. In view of such background, tubular belt rollers are preferred.

However, tubular rollers have a drawback because their strength is reduced in the engagement portion area where the belt straightener is provided. The formation of the engagement portion (i.e., for example, in the form of a groove) in the tubular roller leads to a relatively smaller thickness at the groove portion, thus reducing the roller's strength at the groove portion. If a tubular roller having a relatively large thickness is used to lessen such drawback, the heat capacity of the roller increases, leading to a deterioration of the heat-response time of the tubular roller and lowering the fixability of toner images. Furthermore, the weight of a tubular roller having a relatively larger thickness increases, thereby lessening the desirable weight reduction effect obtained by using the tubular roller.

In order to increase the roller's strength, the depth of the engagement portion can be made shallower. However, a shallower engagement portion may not adequately prevent the belt from waving because belt waving is prevented by the engagement of the belt straightener with an engagement portion having an appropriate depth.

SUMMARY

The present disclosure relates to a tubular roller which supports a belt having an inner surface provided with a protruding circumferential edge. The roller includes an engagement portion which engages with the protruding circumferential edge of the belt, and an inner portion located at an inner circumferential position corresponding to the engagement portion, wherein the inner portion is expanded in an inner radial direction of the tubular roller.

BRIEF DESCRIPTION OF THE DRAWINGS

A more complete appreciation of the disclosure and many of the attendant advantages and features thereof can readily be obtained and understood from the following detailed description with reference to the accompanying drawings, wherein.

DETAILED DESCRIPTION OF EXAMPLE EMBODIMENTS

Figure 1:
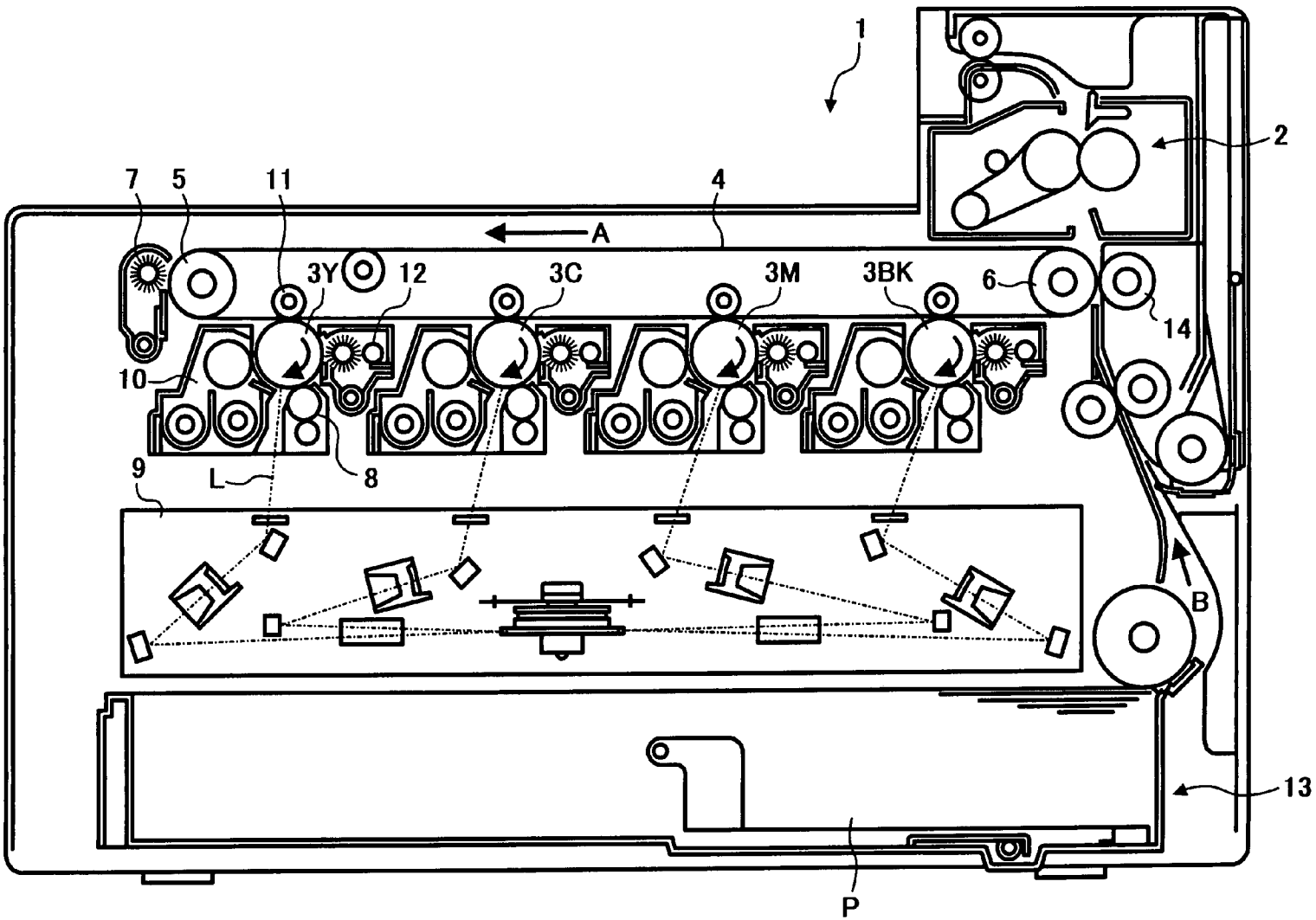
FIG. 1 is a schematic sectional view of an image forming apparatus according to one example embodiment.

In describing example embodiments illustrated in the drawings, specific terminology is employed for the sake of clarity. However, the disclosure of this present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, and more particularly to FIG. 1, where an image forming apparatus according to one example embodiment is illustrated.

FIG. 1 is a schematic sectional view of an image forming apparatus according to one example embodiment. As a non-limiting example, the image forming apparatus 1 in FIG. 1 can be used as a color-copying machine, for example.

As shown in FIG. 1, the image forming apparatus 1 includes a fixing unit 2, image carriers 3Y, 3C, 3M and 3BK, an intermediate transfer belt 4, rollers 5 and 6, a first cleaning unit 7, a charge roller 8, an optical writing unit 9, a developing unit 10, a first transfer roller 11, a second cleaning unit 12, a sheet feed cassette 13, and a second transfer roller 14.

Each of the image carriers 3Y, 3C, 3M, and 3BK are drum-shaped photoconductors on which yellow, cyan, magenta, and black toner images are formed, respectively. The intermediate transfer belt 4 extends around the rollers 5 and 6, and is driven in the direction of arrow A as shown in FIG. 1 by driving either one of the rollers 5 and 6 with a driving unit (not shown). Each of the image carriers 3Y, 3C, 3M, and 3BK has a substantially similar configuration for forming a toner image thereon. Therefore, the image carrier 3Y is used for explaining a toner image formation on the image carriers 3Y, 3C, 3M, and 3BK, hereinafter.

The image carrier 3Y rotates in a clockwise direction as shown in FIG. 1, and a surface of the image carrier 3Y is uniformly charged to a predetermined voltage by the charge roller 8 during such rotation. The charged surface of the image carrier 3Y is scanned by a laser beam "L", modulated and emitted from the optical writing unit 9, to write an electrostatic latent image on the image carrier 3Y. The electrostatic latent image is developed, or made visible, forming a yellow toner image on the image carrier 3Y by the developing unit 10.

As shown in FIG. 1, the first transfer roller 11 and the image carrier 3Y sandwiches the intermediate transfer belt 4 therebetween. The first transfer roller 11, charged with a polarity opposite to the polarity of the toners on the image carrier 3Y, transfers the yellow toner image to the intermediate transfer belt 4 from the image carrier 3Y. Toners remaining on the image carrier 3Y after the transfer process are removed by the second cleaning unit 12.

Similarly, cyan, magenta, and black toner images are formed on the image carriers 3C, 3M, and 3BK, respectively. These toner images are sequentially superimposed on the intermediate transfer belt 4 having the yellow toner image.

The sheet feed cassette 13, provided in a lower portion of the image forming apparatus 1 as shown in FIG. 1, stores a recording medium P, such as transfer sheet and resinous sheet. The recording medium P is fed out in the direction of B shown in FIG. 1, and then fed to a nip position defined by the intermediate transfer belt 4 and the second transfer roller 14. The second transfer roller 14, charged with a predetermined transfer voltage and a polarity different from the polarity of toner images on the intermediate transfer belt 4, transfers the toner images to the recording medium P from the intermediate transfer belt 4. Toners remaining on the intermediate transfer belt 4 after transferring the toner image are removed by the first cleaning unit 7. The recording medium P, having the four color (i.e., yellow, cyan, magenta, black) toner images, is then transported to the fixing unit 2, and the four color toner images are fixed on the recording medium P.

Figure 2:
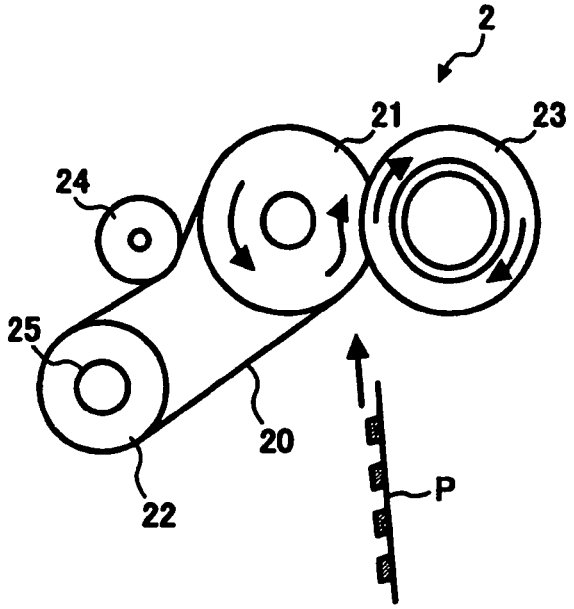
FIG. 2 is a schematic sectional view of a fixing unit in an image forming apparatus according to one example embodiment.

FIG. 2 is a schematic sectional view of the fixing unit 2 in the image forming apparatus 1. As shown in FIG. 2, the fixing unit 2 includes a fixing belt 20, a fixing roller 21, a heat roller 22, a pressure roller 23, a tension roller 24, and a heat source 25. The fixing belt 20 is extended by the fixing roller 21 and the heat roller 22. The fixing belt 20 is firmly contacted to the fixing roller 21 and the heat roller 22 by the tension roller 24. The fixing roller 21 and the pressure roller 23 forms a fixing nip therebetween, and the fixing belt 20 runs through the fixing nip. The fixing belt 20 shaped in an endless belt includes a base layer 20*a*, an elastic layer 20*b*, and an outer layer 20*c* as shown in FIG. 3.

The base layer 20*a* is made of a resinous material such as polyimide having a certain heat-resistance. The base layer 20*a* preferably has a thickness of 50 to 90 μm, which can preferably provide strength and generate a tension force that preferably maintains flexibility of the fixing belt 20 and prevents it from waving. The elastic layer 20*b* formed on the base layer 20*a* is made of an elastic material, such as silicone rubber and fluorinated rubber, and preferably has a thickness of 100 to 300 μm. The elastic layer 20*b* maintains image gloss uniformity, and preferably has a JIS (Japan Industrial Standard)-A hardness of 30 degree or less. The outer layer 20*c*, formed on the elastic layer 20*b*, is made of a resinous material, acting as a releasing layer such as PFA (perfluoroalkoxy) and PTFE (polytetrafluoroethylene), and preferably has a thickness of 20 to 50 μm. A desirable property of the releasing layer is a resistance to toner particle sticking thereon.

One of the preferred methods to make the fixing belt 20 will be now explained. However, those of ordinary skill will understand that other methods also exist. At first, the base layer 20*a* is formed in a belt-shape in a forming process using a melted resinous material, such as polyimide. Then an elastic material, such as silicone rubber and fluorinated rubber, is applied on the base layer 20*a* to form the elastic layer 20*b*. A resinous material, such as PFA (perfluoroalkoxy) and PTFE (polytetrafluoroethylene), is then applied on the elastic layer 20*b* to form the outer layer 20*c*. After that, the base layer 20*a*, the elastic layer 20*b*, and the outer layer 20*c* are baked at a higher temperature to form the fixing belt 20.

Figure 3:
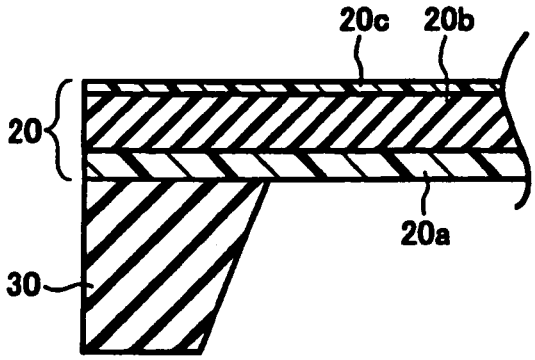
FIG. 3 is a schematic partial view of a fixing belt of a fixing unit according to one example embodiment.

As shown in FIG. 3, the fixing belt 20 is provided with a belt straightener 30 on an inner circumference surface of the fixing belt 20. The belt straightener 30 may be provided on both circumferential portions of the fixing belt 20, for example. The belt straightener 30 is made of an elastic material, such as silicone rubber and fluorinated rubber, which is heat resistant and deformable when winding the fixing belt 20 to the fixing roller 21 and the heat roller 22. Once tension is released, the belt straightener 30 can regain its original shape.

Figure 4:
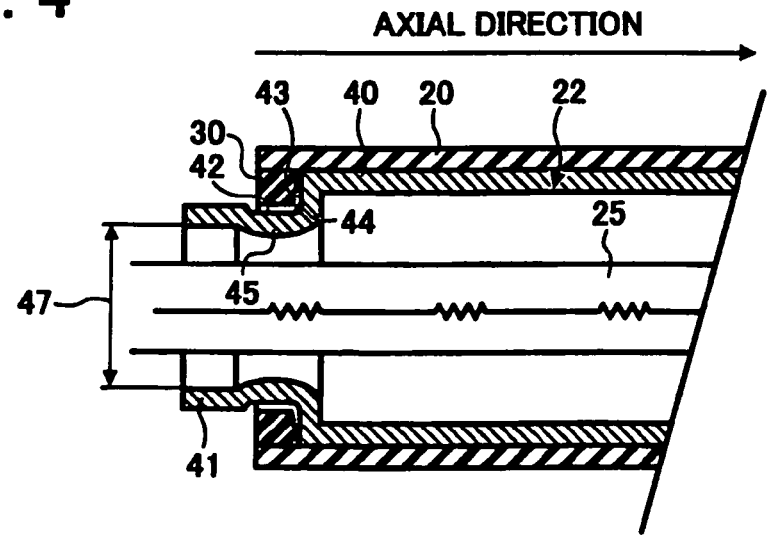
FIG. 4 is a schematic partial view of a heat roller according to one example embodiment.

The belt straightener 30 may be formed in the form of a ring shape to be bonded to the inner circumferential surface of the fixing belt 20 by use of an adhesive material, for example. In such bonding, the adhesive material preferably includes silicione. The belt straightener 30 prevents a movement of the fixing belt 20 in an axial direction, i.e., in a direction parallel to the axis of the fixing roller 21 as shown in FIG. 4. As described later in detail with reference to FIG. 4, the belt straightener 30 engages with a sidewall 43 of an engagement portion 42 of the heat roller 22 to prevent the movement of the fixing belt 20.

In general, the belt straightener 30 has an elasticity, which is larger than that of the fixing belt 20. Accordingly, the belt straightener 30 tends to warp in with a distance S (not shown) in two directions, i.e., outwardly and inwardly with respect to a surface of a first portion 40. For example, the belt straightener 30 warps with respect to the surface of a first portion 40 with −1 mm to 1 mm when the fixing belt 20 is wound to the fixing roller 21 and the heat roller 22. Furthermore, the belt straightener 30 may preferably be cut (i.e., rounded) at its corner with a roundness "R" (not shown) because the belt straightener 30 is made of the elastic material. The roundness "R" (not shown) is approximately 0.5 mm, for example.

Therefore, if a height of the belt straightener 30 is less than "S+R" (e.g., 1.5 mm in the above description), the belt straightener 30 cannot adequately have a portion that faces the sidewall 43 of the engagement portion 42. Therefore, the belt straightener 30 preferably has a height of "S+R" or more (e.g., 1.5 mm or more in the above description).

As shown in FIG. 2, toner images on the recording medium P contact the fixing belt 20, thus it is likely for the recording medium P and the toner images stick to the fixing belt 20. In order to decrease such sticking, the fixing roller 21 is made of a material that is softer than that of the pressure roller 23, such as soft sponge-rubber preferably being heat resistant. Under such condition, the fixing roller 21 changes its form following the shape of the pressure roller 23 (i.e., warping of the fixing nip) as shown in FIG. 2. With such arrangement, the above-described sticking problem can be decreased.

The heat roller 22, having a pipe shape, can be made of metals, such as iron and aluminum, for example, and includes the heat source 25 as shown in FIGS. 2 and 4. The heat source 25 may be a halogen heater, an infrared heater, an induction heater, or the like using heat generated in associated with an electrical resistance. The smaller the thickness of the heat roller 22, the better its ability to dissipate heat is. However, the heat roller 22 experiences a bending stress generated by the tension force exerted by the fixing belt 20, thereby the heat roller 22 made of aluminum preferably has a thickness of 0.4 mm or more, for example.

In order to improve strength, a roller having a larger thickness is preferable. However, the thicker the heat roller 22, the longer the time required for raising its temperature to a fixing temperature. The time for raising the temperature of the heat roller 22 from room temperature (i.e., ambient temperature) to a fixing temperature was measured as a function of roller thickness. This was done in an image forming apparatus using an A4-sized recording medium, an aluminum heat roller of 220 mm in length in the axial direction, and a halogen heater having a power consumption of 850 W accommodated in the heat roller. Table 1 shows the results of these tests.

TABLE 1

| Thickness of heat roller 22 | Time to fixing temperature |
|---|---|
| 0.6 mm | 6.4 sec |
| 0.8 mm | 8.4 sec |
| 1.0 mm | 10.4 sec |

When a power is supplied to the heat source 25, approximately 1 to 1.5 seconds elapse before the temperature of the heat roller 22 actually starts to rise. The power is supplied to the heat source 25 by pushing the power "ON" button of the image forming apparatus 1, for example. According to some surveys for image forming apparatuses, a user can wait approximately 10 seconds for copy-ready mode from the power "ON." Based on such surveys, the thickness of the heat roller 22 can be preferably set to 0.8 mm or less, for which the waiting time can be less than 10 seconds as shown in Table 1. Therefore, the heat roller 22 preferably has a thickness of 0.4 to 0.8 mm, for example.

As shown in FIG. 4, each end of the heat roller 22 includes the first portion 40 having a large outer radius and a second portion 41 having a small outer radius. As shown in FIG. 3, the first portion 40 and the second portion 41 integrally forms a roller having a hollow space inside, and the second portion 41 functions as a journal at both ends of the heat roller 22. The engagement portion 42 of groove type is formed on the heat roller 22 at a position facing the belt straightener 30 of the fixing belt 20 as shown in FIG. 4. The engagement portion 42 is formed by forming a stepped-shape portion in the second portion 41 adjacent to the first portion 40. With such forming, a sidewall 43 is formed to the first portion 40 side of the engagement portion 42. The sidewall 43 preferably has a depth, which is larger than the height of the belt straightener 30.

A corner 44 of the engagement portion 42 may be rounded to approximately 0.3 mm, for example, due to manufacturing conditions. For example, the corner 44 is formed by a cutting process using a cutter. Such cutter inherently has some roundness at its edge. Accordingly, the corner 44 is formed with some roundness. Therefore, the depth of the sidewall 43 can be designed to be larger than the height of the belt straightener 30 by considering the roundness of the corner 44.

An outer radius of an opening 47 of the second portion 41 may be preferably specified so that the heat source 25 can be inserted in the heat roller 22. In order to increase the depth of the sidewall 43, the outer radius of the first portion 40 may be increased. However, the larger the outer radius of the first portion 40, the larger the heat capacity of the heat roller 22, thus slowing down the response to a temperature change, and increasing the heating response of the heat roller 22 unfavorably.

In order to provide the sidewall 43 with an adequate depth while maintaining the outer radius of the heat roller 22 relatively small, the corner 44 can be cut (i.e., rounded) by an amount that is larger than a cut amount defined by the above-mentioned manufacturing condition. With such cutting, the sidewall 43 can provide a depth capable of engaging the belt straightener 30 to the engagement portion 42 while preventing an increase of the heat capacity of the heat roller 22.

Typically, the second portion 41 of the heat roller 22 is formed by drawing the first portion 40 of the heat roller 22 and the engagement portion 42 is formed by cutting the drawn area, thus the thickness around the engagement portion 42 becomes thinner compared to other area. The engagement portion 42 is engaged with the belt straightener 30 to prevent the belt from waving, thereby making the engagement portion 42 susceptible to mechanical stresses. In addition, the belt straightener 30 contacts corner areas of the engagement portion 42 having a smaller thickness due to the above-mentioned cutting process; therefore, the stress concentration is more likely to happen at such corner areas. Accordingly, the heat roller 22 may be likely to fail at such corner areas, if the thickness of the corner areas becomes too thin.

To prevent such drawback, one example embodiment provides an expanded portion 45 in an inner area of the heat roller 22, corresponding to the engagement portion 42 as shown in FIG. 4. The expanded portion 45 can be provided by increasing a thickness of the inner area of the heat roller 22 when conducting a drawing process from the engagement portion 42 to the sidewall 43 as shown in FIG. 4. With the expanded portion 45, even if the engagement portion 42 is formed by cutting, the thickness of the cut area may not become too thin, and corner areas formed by the drawing is less susceptible to stress concentration.

A cutting method can be employed to form the engagement portion 42 on a tubular metal while providing the expanded portion 45 inside of the heat roller 22. However, a formation of the expanded portion 45 and a stepped-shape portion in the heat roller 22 may require a relatively longer time, resulting in an increase of manufacturing cost. In one exemplary embodiment, the heat roller 22 is preferably manufactured with a method shown in FIGS. 5A to 5D, for example.

Figure 5A:
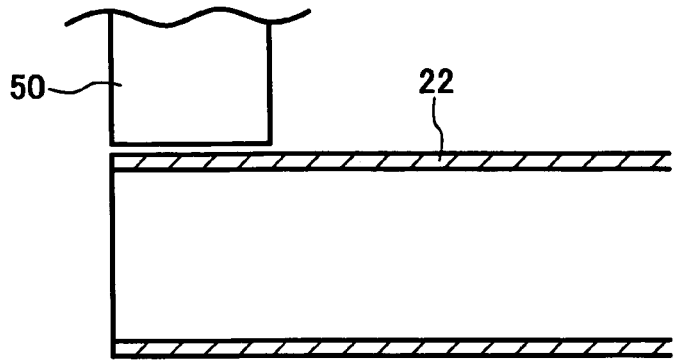
FIGS. 5A, 5B, 5C, and 5D are schematic views explaining a method of producing a heat roller according to one example embodiment.

FIG. 5A shows a tubular metal (e.g., aluminum pipe) to be processed and made as the heat roller 22 and a first punch 50 before conducting the drawing process. The thickness of the tubular metal becomes the thickness of the heat roller 22, and may be set to the above-mentioned range of 0.4 to 0.8 mm, for example.

Figure 5B:
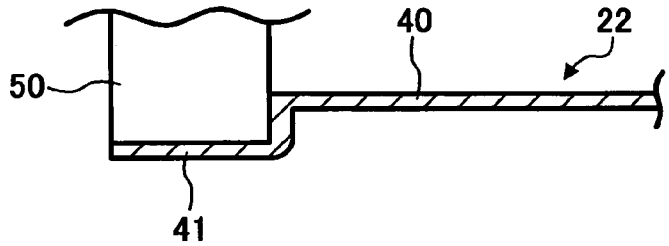
Figure 5C:
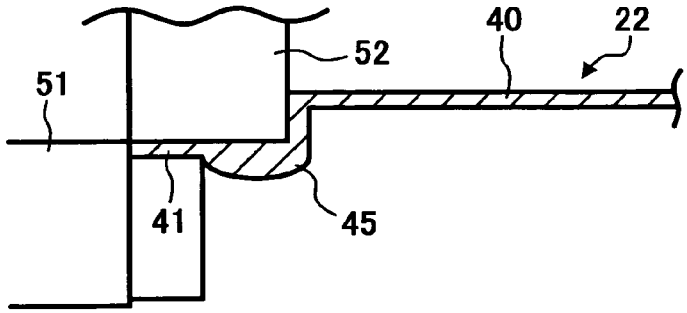
Figure 5D:
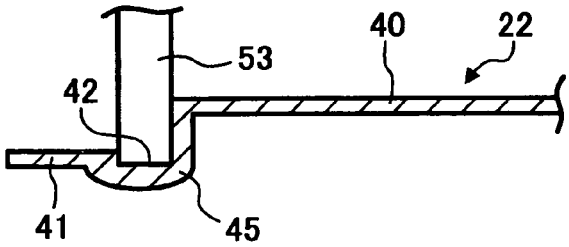

In FIG. 5B, the tubular metal is deformed to a shape having a step in one end portion by the drawing method using the first punch 50 to form the second portion 41. In FIG. 5C, the second portion 41 is pushed by a second punch 51 from an end of the tubular metal to form the expanded portion 45 in an area to be used for forming the engagement portion 42. A dice 52 is attached to the second portion 41 from an outer surface of the tubular metal to prevent unfavorable deformation other than the expanded portion 45. In FIG. 5D, the engagement portion 42 is formed on the heat roller 22 by cutting an area having the expanded portion 45 with a cutting tool 53. The process of forming the second portion 41 (FIG. 5B) and the process of forming the expanded portion 45 (FIG. 5C) can be synchronized to reduce the processing time of the tubular metal.

As above-described, the expanded portion 45 is formed on an inner area of the heat roller 22, which corresponds to the engagement portion 42. The engagement portion 42 is formed by cutting the area having the expanded portion 45, thereby controlling the thickness and strength of the engagement portion 42. Therefore, it is not necessary to increase the thickness of the heat roller 22 in order to increase the strength of the engagement portion 42. As such, a tubular roller manufactured by the above-described method is preferably used to provide a heat roller having a smaller outer radius and smaller heat capacity. In addition, the tubular roller is lighter than a solid-type roller, thus reducing the overall weight of the roller.

For example, the intermediate transfer belt 4, extended by the rollers 5 and 6, may tend to wave, resulting on image displacement. The belt straightener of the present invention may also be provided to the intermediate transfer belt 4 to prevent belt waving. If the roller 6, closely located to the fixing unit 2, employs a roller according to one of the above-described embodiments, a total weight of the intermediate transfer belt unit including the intermediate transfer belt 4 can be reduced. In addition, the roller 6 being made tubular has less heat capacity than a solid-type roller, thereby the roller 6 heated by the fixing unit 2 can be cooled in a shorter time. With such arrangement, the intermediate transfer belt 4 may be less affected by heat effects from the fixing unit 2.

Furthermore, the tubular roller can be cooled by introducing an air flow in an inner space of the roller by a fan or the like to prevent a temperature rise of the roller. Similarly, a transport belt unit including a transport belt and a roller for transporting a recording medium may use the tubular roller configuration as described. As such, the weight of the transport belt unit can be reduced.

Numerous additional modifications and variations are possible in light of the above teachings. It is therefore to be understood that within the scope of the appended claims, the disclosure of the present invention may be practiced otherwise than as specifically described herein.

What is claimed is:

1. A tubular roller configured to support a belt, the belt comprising an inner surface in contact with a surface of the roller, the inner surface including a protruding circumferential edge, the roller comprising:

an engagement portion configured to engage with the protruding circumferential edge of the belt, wherein the roller has a first thickness and a second thickness, the second thickness being greater than the first thickness, and wherein a portion of the roller having the second thickness includes the engagement portion.

2. A tubular roller configured to support a belt having an inner surface provided with a protruding circumferential edge having a width in an axial direction of the roller, the tubular roller comprising:

a first portion having a first outer radius, the first portion being configured to contact the inner surface of the belt; and a second portion having a second outer radius smaller than the first outer radius of the first portion; and a third portion connected to the first portion with a first vertically extending wall and to the second portion with a second vertically extending wall, the third portion having a third outer radius smaller than the second outer radius.

3. The tubular roller according to claim 2, wherein the first vertically extending wall has a vertical height equal to a difference between the first outer radius and the third outer radius and the second vertically extending wall has a vertical height equal to a difference between the second outer radius and the third outer radius.

4. The tubular roller according to claim 2, wherein the third portion has a width that is greater than the width of the circumferential edge.

5. A fixing unit configured to fix a toner image on a recording medium in an image forming apparatus, comprising:

a fixing belt comprising an inner surface including a protruding circumferential edge;

a first roller configured to support and heat the fixing belt, the first roller comprising:

an engagement portion configured to engage with the protruding circumferential edge of the fixing belt; and a heater provided in an inner space of the first roller, wherein the roller has a first thickness and a second thickness, the second thickness being greater than the first thickness, and wherein a portion of the roller having the second thickness includes the engagement portion;

a second roller configured to support the fixing belt with the first roller and to fix the toner image on the recording medium; and a third roller configured to press the fixing belt toward the second roller.

6. A fixing unit configured to fix a toner image on a recording medium in an image forming apparatus, comprising:

a fixing belt including an inner surface provided with a protruding circumferential edge having a width;

a first roller configured to support and heat the fixing belt, the first roller comprising:

a first portion having a first outer radius, the first portion being configured to contact the inner surface of the fixing belt; and a second portion having a second outer radius smaller than the first outer radius of the first portion;

a third portion connected to the first portion with a first vertically extending wall and to the second portion with a second vertically extending wall, the third portion having a third outer radius smaller than the second outer radius; and a heater provided in an inner space of the first roller;

a second roller configured to support the fixing belt with the first roller and to fix the toner image on the recording medium; and a third roller configured to press the fixing belt toward the second roller.

7. The fixing unit according to claim 6, wherein the first vertically extending wall has a vertical height equal to a difference between the first outer radius and the third outer radius and the second vertically extending wall has a vertical height equal to a difference between the second outer radius and the third outer radius.

8. The fixing unit according to claim 6, wherein the third portion has a width that is greater than the width of the circumferential edge.

9. The fixing unit according to claim 6, wherein the second roller and the third roller define a nip, through which the recording medium is passed to fix the toner image on the recording medium.

10. The fixing unit according to claim 6, further comprising a fourth roller configured to exert a tension to the fixing belt supported by the first roller and the second roller.

11. The fixing unit according to claim 6, wherein the first roller is formed of a tubular metal having a thickness of 0.8 mm or less.

12. The fixing unit according to claim 11, wherein the metal comprises aluminum.

13. An image forming apparatus, comprising:

an image carrier configured to carry a toner image thereon;

a recording medium configured to receive the toner image directly or indirectly from the image carrier; and a fixing unit configured to fix the toner image on the recording medium, comprising:

a fixing belt comprising an inner surface including a protruding circumferential edge;

a first roller configured to support and heat the fixing belt, the first roller comprising:

an engagement portion configured to engage with the protruding circumferential edge of the fixing belt; and a heater provided in an inner space of the first roller, wherein the roller has a first thickness and a second thickness, the second thickness being greater than the first thickness, and wherein a portion of the roller having the second thickness includes the engagement portion;

a second roller configured to support the fixing belt with the first roller and to fix the toner image on the recording medium; and a third roller configured to press the fixing belt toward the second roller.

14. An image forming apparatus, comprising:

an image carrier configured to carry a toner image thereon;

a recording medium configured to receive the toner image from the image directly or indirectly carrier;

a fixing unit configured to fix the toner image on the recording medium, comprising:

a fixing belt including an inner surface provided with a protruding circumferential edge having a width;

a first roller configured to support and heat the fixing belt, the first roller comprising:

a first portion having a first outer radius, the first portion being configured to contact the inner surface of the fixing belt; and a second portion having a second outer radius smaller than the first outer radius of the first portion;

a third portion connected to the first portion with a first vertically extending wall and to the second portion with a second vertically extending wall, the third portion having a third outer radius smaller than the second outer radius; and a heater provided in an inner space of the first roller;

a second roller configured to support the fixing belt with the first roller and to fix the toner image on the recording medium; and a third roller configured to press the fixing belt toward the second roller.

15. The image forming apparatus according to claim 14, wherein the first vertically extending wall has a vertical height equal to a difference between the first outer radius and the third outer radius and the second vertically extending wall has a vertical height equal to a difference between the second outer radius and the third outer radius.

16. The image forming apparatus according to claim 14, wherein the third portion has a width that is greater than the width of the circumferential edge.

17. The image forming apparatus according to claim 14, wherein the second roller and the third roller define a nip, through which the recording medium is passed to fix the toner image on the recording medium.

18. The image forming apparatus according to claim 14, further comprising a fourth roller configured to exert a tension to the fixing belt supported by the first roller and the second roller.

19. The image forming apparatus according to claim 18, wherein the metal comprises aluminum.

20. The image forming apparatus according to claim 14, wherein the first roller is formed of a tubular metal having a thickness of 0.8 mm or less.

21. Am image forming apparatus, comprising:

an image carrier configured to carry a toner image thereon;

an intermediate transfer belt configured to receive the toner image from the image carrier, the intermediate transfer belt comprising an inner surface including a protruding circumferential edge having a width and being supported by a tubular roller comprising:

an engagement portion configured to engage with the protruding circumferential edge of the intermediate transfer belt, wherein the roller has a first thickness and a second thickness, the second thickness being greater than the first thickness, and wherein a portion of the roller having the second thickness includes the engagement portion;

a recording medium configured to receive the toner image directly or indirectly form the image carrier; and a fixing unit configured to fix the toner image on the recording medium.

22. An image forming apparatus, comprising:

an image carrier configured to carry a toner image thereon;

a recording medium configured to receive the toner image directly or indirectly from the image carrier;

a transport belt for transporting the recording medium, the transport belt comprising an inner surface including a protruding circumferential edge having a width and being supported by a tubular roller comprising:

an engagement portion configured to engage with the protruding circumferential edge of the transport belt; and wherein the roller has a first thickness and a second thickness, the second thickness being greater than the first thickness, and wherein a portion of the roller having the second thickness includes the engagement portion;

a fixing unit configured to fix the toner image on the recording medium.

* * * * *